US005340271A

United States Patent [19]

Freeman et al.

[11] Patent Number: 5,340,271

[45] Date of Patent: * Aug. 23, 1994

[54] FLOW CONTROL METHOD AND MEANS

[75] Inventors: Christopher Freeman, Farnsfield; Ivor J. Day, Toft; William B. Wright, Kegworth, all of England

[73] Assignee: Rolls-Royce plc, London, United Kingdom

[ * ] Notice: The portion of the term of this patent subsequent to Jan. 4, 2011 has been disclaimed.

[21] Appl. No.: 960,367

[22] PCT Filed: Aug. 19, 1991

[86] PCT No.: PCT/GB91/01407

§ 371 Date: Jan. 14, 1949

§ 102(e) Date: Jan. 14, 1993

[87] PCT Pub. No.: WO92/03661

PCT Pub. Date: Mar. 5, 1992

Related U.S. Application Data

[63] Continuation-in-part of Ser. No. 573,821, Aug. 28, 1990.

[30] Foreign Application Priority Data

Aug. 18, 1990 [GB] United Kingdom ..... 9018188.4

[51] Int. Cl.[5] ..... F01D 17/08

[52] U.S. Cl. ..... 415/1; 415/26; 415/47; 415/51; 415/58.5; 415/116; 415/118; 415/119; 60/39.091; 60/39.29

[58] Field of Search ..... 415/1, 17, 26–29, 415/47, 49, 51, 58.4, 58.5, 58.7, 116, 117, 118, 119; 60/39.091, 39.29

[56] References Cited

U.S. PATENT DOCUMENTS

| | | | |
|---|---|---|---|
| 2,084,462 | 6/1937 | Stalker | 415/116 |
| 2,599,470 | 6/1952 | Meyer | 415/58.7 |
| 3,602,605 | 8/1971 | Lee et al. | 415/116 |
| 4,196,472 | 4/1980 | Ludwig et al. . | |
| 4,255,083 | 3/1981 | Andre et al. . | |

FOREIGN PATENT DOCUMENTS

| | | | |
|---|---|---|---|
| 0221310 | 6/1958 | Australia | 415/58.5 |
| 3623696 | 1/1988 | Fed. Rep. of Germany . | |
| 1136881 | 5/1957 | France . | |
| 2248427 | 5/1975 | France . | |
| 0619722 | 4/1949 | United Kingdom | 415/58.7 |
| 792343 | 3/1958 | United Kingdom . | |
| 1481031 | 7/1977 | United Kingdom . | |
| 2191606 | 12/1987 | United Kingdom . | |

OTHER PUBLICATIONS

"Tests of an Improved Rotating Stall Control System on a J-85 Turbojet Engine", G. R. Ludiwig, AFAPL-TR-79-2060 Air Force Aero-Propulsion Laboratory, Wright-Patterson AFB, Ohio, Aug. 1979.

"Presentation to the Workshop on Applications of Active Control to Engineering Systems", I. J. Day, Cambridge, U.K., Jun. 1990.

Journal of Propulsion and Power, vol. 5, No. 2, 1989, A. H. Epstein et al., "Active suppression of aerodynamic instabilities in turbomachines", pp. 204–211.

*Primary Examiner*—Edward K. Look
*Assistant Examiner*—Christopher Verdier
*Attorney, Agent, or Firm*—Oliff & Berridge

[57] ABSTRACT

The method controls gas flow in an axial flow compressor in which the flow at one or more chosen station in the direction of flow through the compressor is sensed at a series of circumferentially spaced positions. Flow variations above a predetermined limit are evaluated to initiate a response if a disturbance above a predetermined acceptable level is detected. When such a disturbance is detected, higher pressure gas bled from downstream is injected at a station to supplement the main gas flow. An incipient rotating stall cell will appear as a variation occurring sequentially at the circumferentially spaced positions. By responding to such a condition with a pressure injection, it is found possible to suppress both rotating stall and surge conditions in the compressor before this disturbance develops fully. The same method can be arranged to counter steady state distortion.

33 Claims, 9 Drawing Sheets

PRESSURE RISE COEFFICIENT (ΔP/ρU²)
1.7
1.6
1.5
1.4
1.3
1.2
0.40
0.45
0.50
0.55
0.60
FLOW COEFFICIENT (Cx/U)
A
B
EXTENDED RANGE OF OPERATION

FLOW CONTROL METHOD AND MEANS

This application is a continuation-in-part of co-pending application Ser. No. 07/573,821, filed Aug. 28, 1990.

FIELD OF THE INVENTION

This invention relates to a method of and means for the control of flow disturbances in turbo-compressors, including both instabilities such as the phenomena of rotating stall and surge, in particular axial turbo-compressors, and steady state or quasi steady state disturbances.

BACKGROUND OF THE INVENTION

Rotating stall is an aerodynamic instability which determines the maximum pressure rise capabilities of a turbo-compressor. At that maximum any further demand will lead to the formation of a small patch (usually referred to as a "cell") of disturbed flow in the blading which can then spread rapidly to engulf a large proportion of the annular cross-section of the compressor. As the stall cell forms fully, the delivery pressure at the exit from the compressor falls off just as rapidly. This type of disturbance is called rotating stall because the disturbed or "blocked" sector of the annulus will rotate with the blading, at roughly half (typically between 0.8 and 0.3) the speed of the blading.

The system-related instability of surge occurs when a compressor is coupled to a large downstream volume, eg. pipework in an industrial plant or the combustion chamber in a gas turbine. If the pressure rise capability of the compressor is exceeded and a stall condition is initiated there is a fall in delivery pressure which allows compressed gas in the volume downstream of the compressor to blow back through the compressor. In extreme cases this can lead to flames spewing out of the front of an engine. Venting the downstream volume in this way lowers the back pressure on the compressor; the stall condition disappears and the pressure downstream is able to rise again as the downstream volume is refilled. The stalling, venting, refilling cycle will thus start again and a continuous sequence of surge cycles can ensue if the operating conditions remain unchanged.

It has been proposed in GB 1481031 to detect the flow reversal that occurs with surge, and then to bleed off the boundary layer in the downstream region of the compressor to return this air to the inlet. Such a procedure is inherently inefficient, however, not least because its operation relies upon the surge condition becoming established.

Both stall and surge will limit the operating range of a machine and are damaging conditions. Rotating stall leads to very high temperatures in the compressor and surge leads to to violent bending loads on the blading. The accepted way of avoiding these dangers has been to ensure the compressor does not work close to its peak pressure rise. In recent times, however, it has been suggested that active control techniques might be employed to improve performance. Reference can be made to GB 2191606A and to Epstein AH, Ffowcs-Williams JE, and Greitzer EM, "Active Suppression of Aerodynamic Instabilities in Turbomachinery", AIAA *Journal of Propulsion and Power,* Vol 5, No 2 1989.

In U.S. Pat. No. 4196472 (Ludwig et al) a stall control system for an axial flow compressor is disclosed in which signals from a number of pressure transducers within the compressor are compared with a reference signal, the value of which is related to the operating conditions in the compressor. The signals from the individual transducers are compared sequentially with the reference signal so that corrective action can be initiated when an abnormal value is sensed by any one sensor. The signals are also summed, and the strength of the corrective action is determined by the summed signal value. The form of corrective action described in U.S. Pat. No. 4196472 takes the form of a controllable bleed from the compressor gas passage, and control of the stagger angle of the stator blades is also suggested.

SUMMARY OF THE INVENTION

A novel manner of controlling disturbances such as rotating stall and surge in turbo-compressors is now proposed in which variations in the flow are sensed at a series of circumferentially spaced positions at a chosen station in the direction of flow through the compressor to detect variations above a predetermined variation limit.

In accordance with one aspect of the invention, upon such a variation being detected, within the compressor there is injected into a first axial region, spaced from the compressor exit a flow of higher-pressure gas from a second axial region of the compressor downstream of the first region, said injection being directed generally in said direction of flow and in a circumferentially selective manner dependent upon the different circumferential origins of said variations, to act against the flow disturbances indicated by said variation.

According to another aspect of the invention, the sensing of said variations at a series of said positions in circumferential sequence actuates the injection into the compressor, at a region spaced from the compressor exit, of a flow of gas at a higher pressure than that prevailing at the region of injection to act against a flow disturbance indicated by said variations.

A significant feature of the present invention, the use of injected gas to counter a flow disturbance, has the advantage over the method proposed by U.S. Pat. No. 4196472 that the injection of gas improves the basic surge margin of the compressor. The compressor is therefore capable of operating at a higher output than would be the case with a prior art bleed system.

Rotating stall conditions may also be experienced in turbo-compressors at low speed, part load conditions. In this case, the instability is found to occur at the front of the compressor. Because the machine is then working at a lower compression ratio than the optimum for which it is designed the early stages are relatively highly loaded compared with the rearmost stages. The flow at the front of the compressor can then reach stalling point, giving an uncontrolled loss of power. The present invention can also be employed to counter this problem by the injection of higher pressure gas into the foremost stages of a turbo-compressor, preferably at the front stage, in a similar manner to that described for high speed operation.

In a more general sense, any axial region of the compressor may be chosen for the flow injection, depending upon the nature of the disturbance to be countered. It is necessary to ensure that the injection pressure is sufficient to obtain an adequate energy input at a location where it will influence the flow disturbance sensed, but for greatest efficiency the pressure differential should be kept as low as is practical. If a flow is to be injected at the front of the compressor, it may not be desirable therefore to take the injected air from the compressor outlet. From the point of view of aerodynamic efficiency, it would be desirable to have a multiplicity of successive flow injection circuits along the compressor flow path, each spanning only a small part of that path, but the mechanical complexity of such an arrangement will normally be impractical.

It may be sufficient to provide the sensing and injection means at a single axial station but, as indicated, the provision of such means at a number of stations is not precluded and may be preferred. As a practical measure, both high and low speeds stalling can be countered with relatively simple means if there are tappings at the front, rear and intermediate regions of the compressor, so enabling an injection from the rear or outlet to the intermediate region to counter high speed stall in response to detection means at the intermediate region, and from the intermediate region to the front or entry region to counter low speed stall in response to detection means at the entry region.

The critical axial station or stations at which a flow disturbance will be initiated can be expected to vary with different designs of turbo-compressor and the locations of the injection and sensing means may therefore be selected empirically. There may also be a need to monitor the compressor flow near its outlet end for incipient surge conditions, independently of monitoring for rotating stall further upstream.

It is possible within the scope of the invention to employ any desired pattern of gas injection. For example, in response to the sensing of a rotating flow variation gas may be injected sequentially through a circumferentially spaced series of ports at a station. Alternatively, gas may be injected simultaneously through said series of ports. Where there are gas injection means at a number of axially spaced stations they can be actuated in response to sensed variations at their respective stations or at other stations as appropriate. Where the control system is deployed at a number of axial stations, it may be operated independently at each station or the gas injection at the different stations can be coordinated, eg. to operate in unison or in a predetermined sequence.

The method of the present invention can also be employed to counter flow distortions where the flow distribution is non-uniform in the circumferential sense. This condition can occur in aero-engines during transient maneuvers or when the aircraft is travelling at low speed with the engine axis at a larger angle than usual to the flight path, such as can occur at take-off. A part of the engine air intake area is then effectively "shadowed" by the cowling upstream of it and there can be break away of the flow in the first stage of the compressor.

For this type of disturbance it may be preferred to rely on sensors at a number of spaced axial stations, with coordination of the signals from different stations so that gas injection is triggered if a number of sensors at different stations but with similar circumferential positions, give an operative signal.

It is also possible, however, to rely on sensing upstream of the compressor to counter such static or relatively static disturbances. For example when the compressor is operating in a nacelle, circumferential non-uniformities can appear in the nacelle ahead of the engine entry. It is also within the scope of the invention to provide a method and means whereby the detection of such disturbances is employed to trigger the injection, substantially at the compressor inlet, of gas bled from further downstream in the compressor. Such disturbances may require the flow injection only over a part of the circumference of the compressor.

According to a further aspect of the invention, apparatus having means for sensing variations in the flow at a series of circumferentially spaced positions at a chosen station in the direction of flow through a turbo-compressor also comprises means for tapping higher pressure gas from the compressor downstream of said station and for reinjecting said higher pressure gas into the compressor at or adjacent said station, generally in said direction of flow, and control means for permitting said injection to take place, the sensing means actuating said control means in a circumferentially selective manner dependent upon the circumferential origins of the variations sensed, thereby to act against the flow disturbances indicated by said variations.

In yet another aspect of the invention, apparatus for controlling gas flow in a turbo-compressor comprises flow sensing means for a series of circumferentially spaced positions at a chosen axial station in the direction of flow through the compressor, means for detecting from signals from the sensing means at the individual positions flow variations above a predetermined variation limit, means for injecting a flow of gas at a higher pressure than that prevailing at said station and generally in the direction of flow, means for actuating said injection means in response to the sensing of said variations at a series of said positions in circumferential sequence thereby to act against a flow disturbance indicated by said variations.

In a preferred method of operation, when an injection flow is triggered, the or each valve controlling the flow is automatically re-shut after an interval, which may be a preset period, since a continuous injection of high-pressure gas would be uneconomic. It may be preferred to do this by tapering off the initial flow whereby the flow control effect is removed gradually. This is particularly applicable when a relatively lengthy period of injection flow is needed to influence the disturbance; should the disturbance appear again before the flow has been shut off, the rate of flow can be increased again to its initial value. With repeated tapering and restoration of the flow, it is ensured that the flow is kept to the minimum to control the disturbance and is cut off as soon as the cause of the disturbance disappears. Moreover, a timed tapering of the injection flow is able to limit the energy input for operating the corrective system without impairing its efficiency. In particular flow systems, however, an on-off characteristic may be equally effective and has the advantage of simplicity. If the disturbance remains when the preset interval has expired, a further period of injection can be immediately initiated. It may also be arranged that the responses of the components of the system ensure in that case that the injection flow is not interrupted between the two periods.

It is significant that the invention can be utilized, whether the control flow is tapered off or is simply cut off, without the control means using a feedback loop. It is possible to initiate corrective action at a maximum rate when gas injection begins, subject only to the threshold disturbance level having been exceeded. If thereafter the injection flow is cut off or its rate of injection is tapered off, it can be assured that full corrective action is restored at any stage if the disturbance continues or restarts. The arrangement permits considerable simplification, as compared with prior art arrangements, without impairing the ability to control disturbances. It is also possible very simply to provide manual actuating means which allows the operator to put the arrangement into operation.

In a preferred control arrangement according to the invention, each sensor signal is averaged with a plurality of immediately preceding sensor signals. A mean value is obtained and a difference signal is then formed between the instantaneous and mean signals. If a measure of the relative magnitude of the difference signal is taken, the detection of signal relative magnitudes above a predetermined level can be arranged to produce an operative output. The generation of a series of operative outputs from a plurality of the sensors can then be employed to actuate the injection means in a sequential pattern.

The sampling period, at a given rotational speed, determines the maximum rate of response of the system. It may be desired and it can be made possible to have a sampling period occupying less than one revolution of the compressor. For example, if three sensor outputs are required to give the mean signal and there is a series of six equiangularly spaced sensors, a rolling period of 1/2 revolution can be used for averaging the mean value from three successive sensors; comparing the instantaneous signal from one of these sensors with the mean value determines whether an operative output is generated.

In the operation of the apparatus sequential operative outputs from all or some of the circumferentially spaced sensors at a particular axial station would indicate rotating stall, while simultaneous operative outputs from all or some of said sensors would indicate a surge condition. In either case a gas injection process would be initiated appropriate to the type of disturbance sensed. That is to say, a stall condition would be countered by circumferentially sequential injections of gas, whereas all the injection ports would be opened simultaneously for a surge condition.

It is also possible to arrange for opening of all injection ports simultaneously in response to an indication of rotating stall. This is a less economic use of the pressurized air but it has the advantage of simplicity, especially as only a single valve may be needed.

When responding to a circumferential sequence of operative outputs from the sensors, it may be found appropriate to actuate the sequential gas injection at a different phase for optimum results in a particular installation. This will not usually be necessary, however, and in a typical axial flow compressor it can De assumed that a disturbance is generally axial in nature. It may therefore be preferred to have gas injection locations axially coincident with downstream locations of tappings for the higher pressure bleed. If a rotating disturbance is to be suppressed, the sequential operation of the gas injection around the circumference of the rotor can act against the disturbance both at the gas injection and at the gas extraction locations.

The flows through the injection locations are controlled by respective valves for individual ports or groups of ports. By grouping the ports the apparatus is simplified but the amount of injection air needed is increased. It may be preferred to provide multiple orifice ports spread over a sector of the circumference at each gas injection location to improve the distribution of the injected flow.

The outlets should direct their flows towards the high-pressure end of the compressor. For an axial flow compressor the outlet should be directed at an angle in the radial plane not substantially more than 30° from the compressor casing in that plane, which will be less than 30° to the main flow streamlines. The flow may be directed circumferentially in an oblique direction that opposes the direction of rotation of the compressor.

It may also be found useful for an operative signal at one station to actuate an injection flow of another station, for example, if a flow disturbance is more easily detected at a station downstream from its initiation, as for example the appearance of rotating stall nearer the compressor outlet at higher speeds. As a practical matter also, the sensing means should not be disposed so close to the gas injection sites that their signals are disturbed by the inflowing gas.

BRIEF DESCRIPTION OF THE DRAWINGS

Reference will be made to the accompanying drawings for a further description of the invention. In the drawings.

DETAILED DESCRIPTION OF PREFERRED EMBODIMENTS

Figure 3:
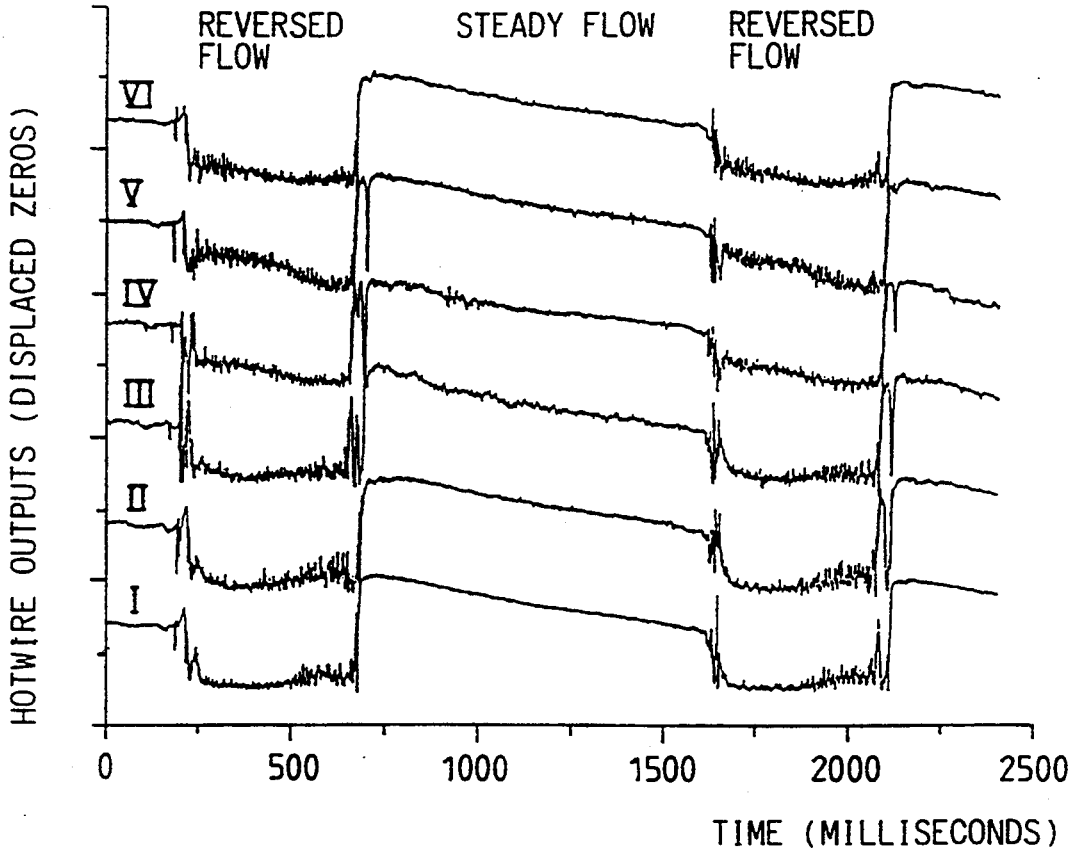
Figure 4:
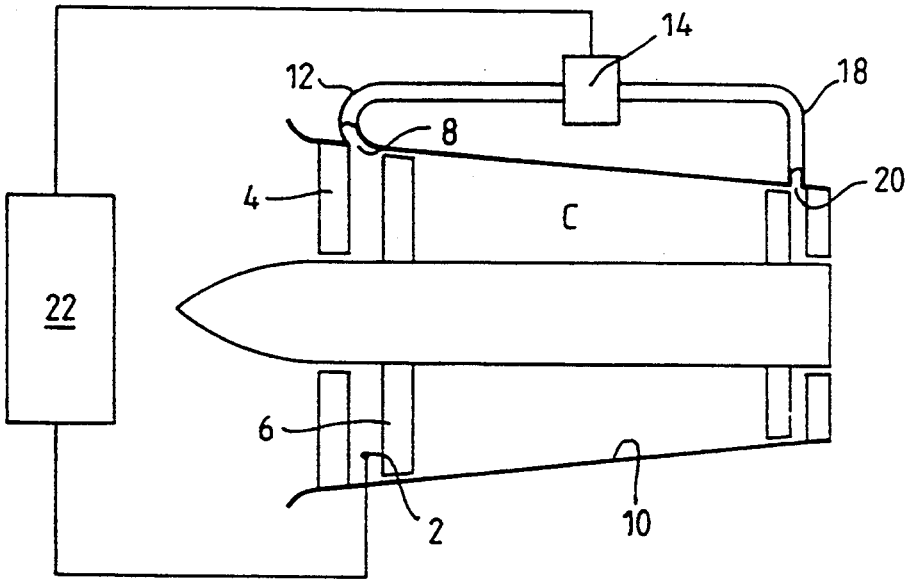
FIG. 4 is a schematic illustration of the air compressor provided with flow control means according to the invention.

Observations indicate that a stall cell in an axial flow compressor can grow from an undetectable disturbance to a fully developed blockage in a matter of milliseconds; this development will usually take place over about 4 to 6 revolutions of the compressor rotor. The stall cell may make its first appearance at any point around the flow passage through the compressor, so that a series of spaced sensors are needed to detect the origin and development of a stall cell. Experiments testing the basis of the present invention were made using a turbo-compressor with a series of hot-wire sensors spaced circumferentially around an axial position immediately ahead of the first rotor disc as shown in FIG. 4 (in fact, less than half a blade chord upstream of the rotor disc) and located radially inwards from the compressor casing by about one third of the radial depth of the flow passage. In the series of experiments shown in FIGS. 1 to 3 and FIGS. 5 to 11, simultaneous traces are plotted from a series of sensors at equal circumferential spacings.

Figure 1:
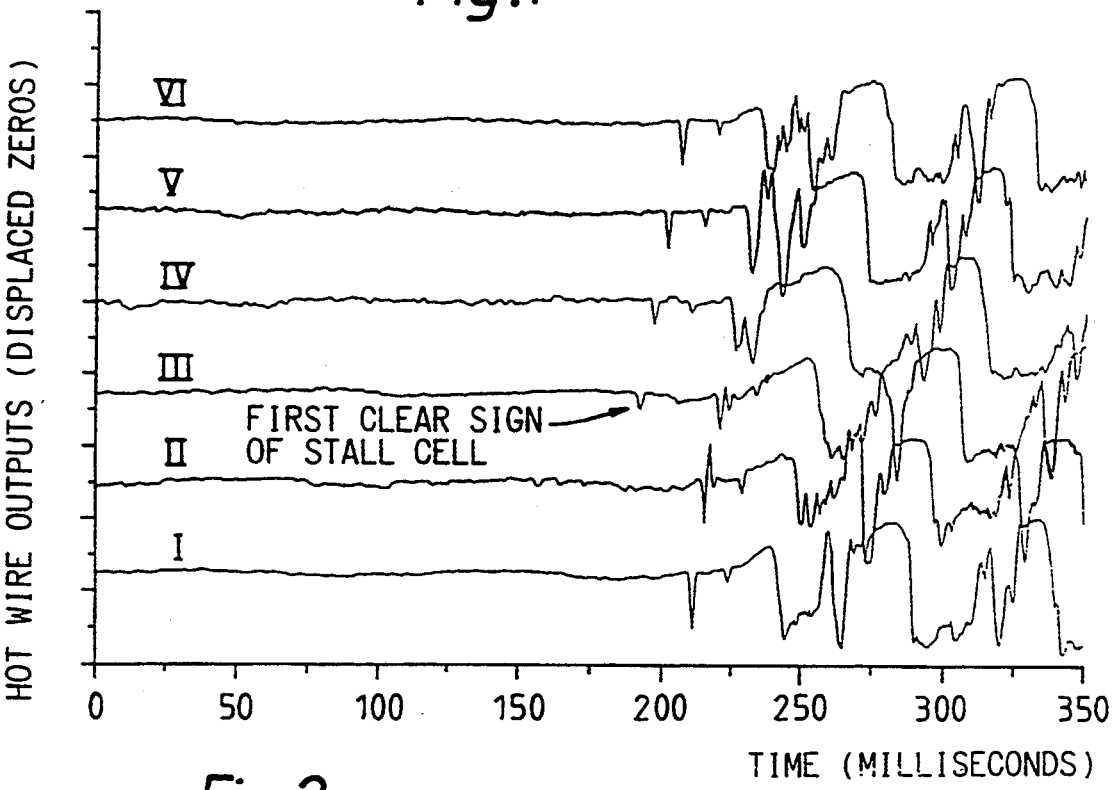
FIGS. 1 to 3 are plots of a series of simultaneous air flow measurements from circumferentially spaced sensors at the entry end of an axial flow air compressor.

In FIG. 1, where the outputs from six circumferentially spaced hot-wire sensors I–VI are shown, the flow into the compressor is initially in a steady state with a very low level of disturbance. An emerging stall cell can first be seen as a small disturbance, namely the v-shaped peak at A in trace III, which grows progressively as it passes each successive sensor. By the end of its third cycle the stall cell is a fully developed disturbance rotating steadily around the annular passage.

Figure 2:
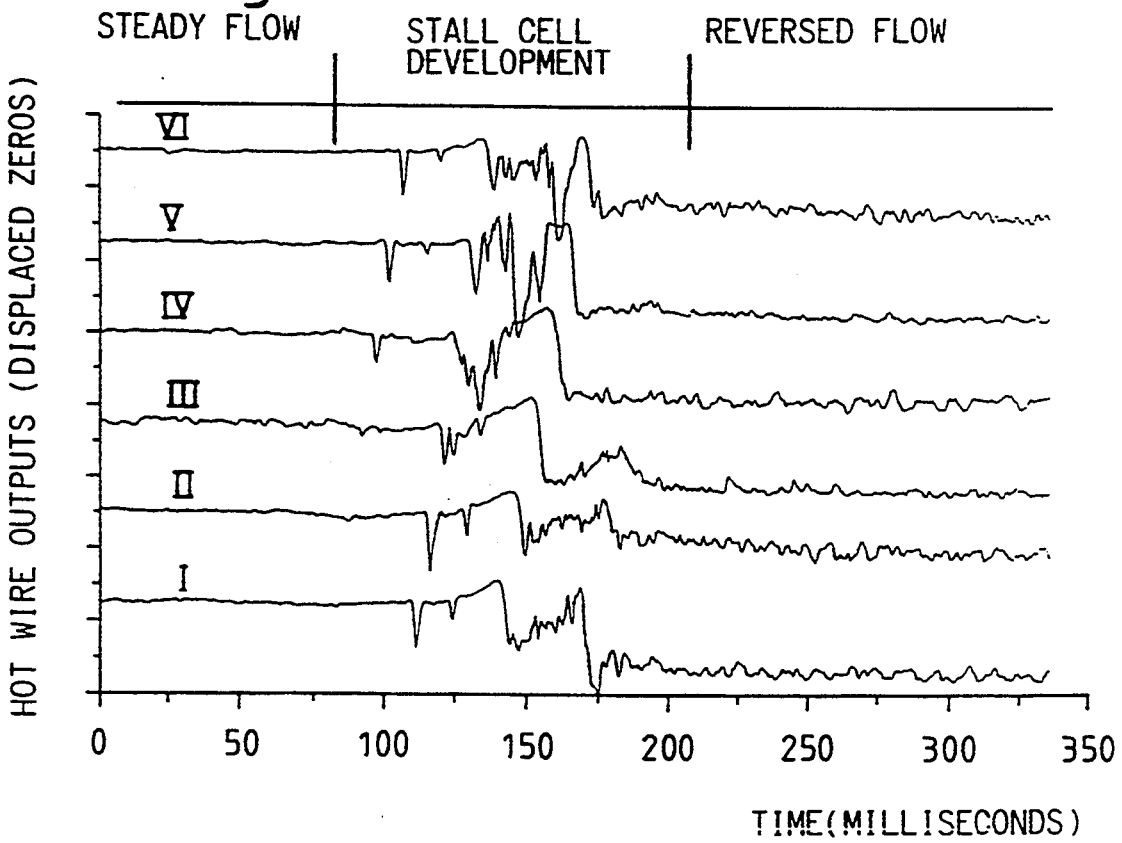

Through a similar series of traces FIG. 2 illustrates to the same time scale as FIG. 1 the initiation of a surge cycle, the first sign of which is the v-shaped stall cell emerging first in trace IV. The subsequent development after a couple of revolutions is notably different from the development of rotating stall, and the outputs from all the sensors show a concurrent and relatively long-lived drop of flow rate. In fact, only the first part of the surge cycle appears in FIG. 2 and FIG. 3 shows, over a longer time scale, the complete "stall-backflow-refill" sequence- Steady flow, dropping slightly as the back pressure builds up, finally breaks down and the flow reverses, steady flow being resumed again at a higher rate because of the reduced back pressure. It is significant to note that these experimental results show that both stall and surge begin with the formation of a small, sharply defined patch of stalled flow, although it will not necessarily exhibit the v-shape profile that appears in the illustrated traces. This is despite the fact that, as a system related phenomenon, surge might be expected to develop as some form of "volume and duct" instability.

FIG. 4 illustrates in outline the axial flow compressor C equipped with flow control means in accordance with the invention. The hot wire sensors 2 can be seen immediately between a ring of fixed guide vanes 4 and a ring 6 of rotor blades. At the same axial position but circumferentially spaced from the sensors a circumferentially distributed series of air inlets 8 (only one of which is shown) blend tangentially with the inner wall 10 of the compressor casing. The inlets are directed rearwards into the adjacent rotor blade ring. The inlets are set at an angle in the circumferential sense that may be determined empirically but that preferably directs them counter to the direction of rotation of the rotor. The inlets 8 are connected by conduits 12 through respective fast-acting shut-off valves 14, to a series of conduits 18 leading from a number of tappings 20 similarly distributed around the circumference of the high-pressure end of the compressor to supply high-pressure air for injection through the inlets.

The valves 14 are normally shut but can be opened by a control circuit 22 in dependence upon the signals from the sensors 2. As will be described in more detail below, detection of a disturbance by some or all of the sensors greater than the anticipated level of noise in the steady flow at the compressor inlet triggers the opening of the valves 14 to inject onto the first ring of rotor blades 6 the high pressure flow bled from the outlet end of the compressor.

Figure 5:
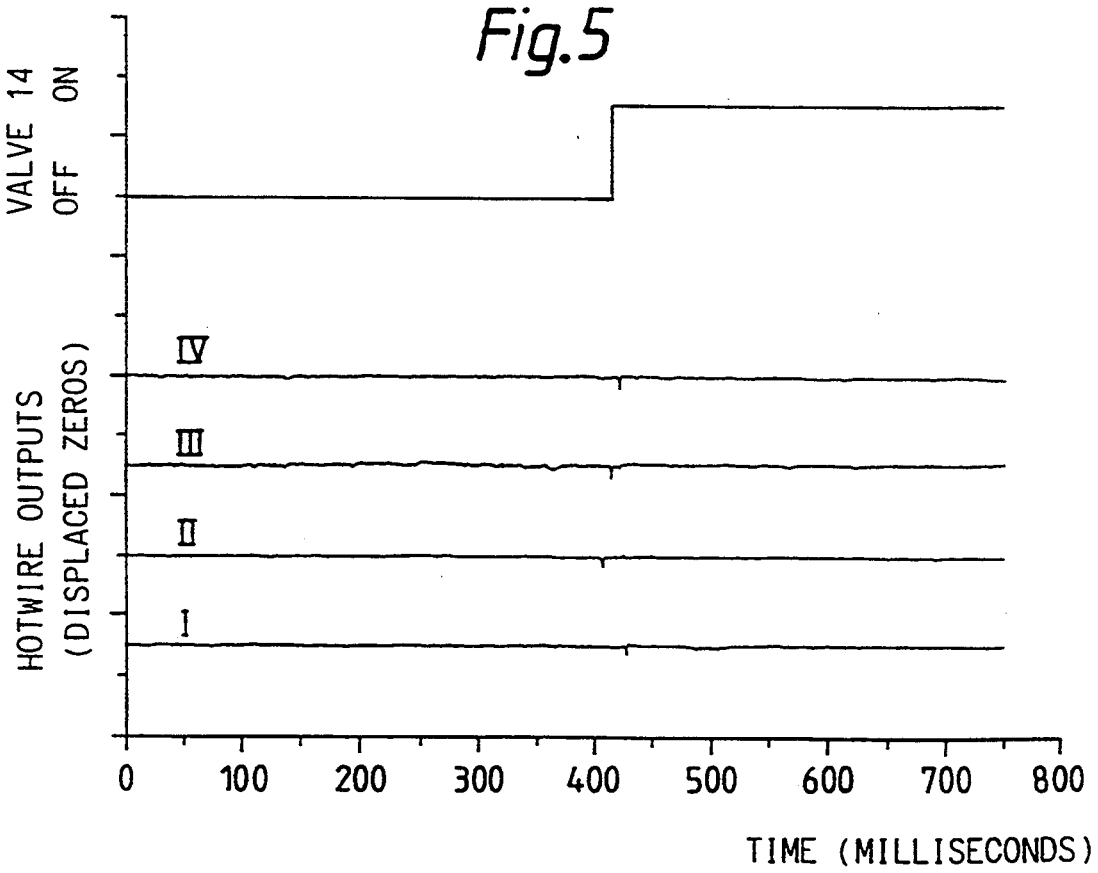
FIGS. 5 to 11 are further plots of air flow measurements in the compressor illustrating the operation of the flow control means.

In FIG. 5 the outputs from a series of four equispaced hot-wire sensors are shown, with a stall cell appearing first in the trace of sensor II. As the stall cell circulates past sensors III and IV, the control circuit 22 is able to confirm that the disturbance is not an instrument fault and the output from the control circuit is turned on to open the valves 14. FIG. 5 demonstrates how the injection of high pressure air immediately suppresses the stall cell.

Figure 6:
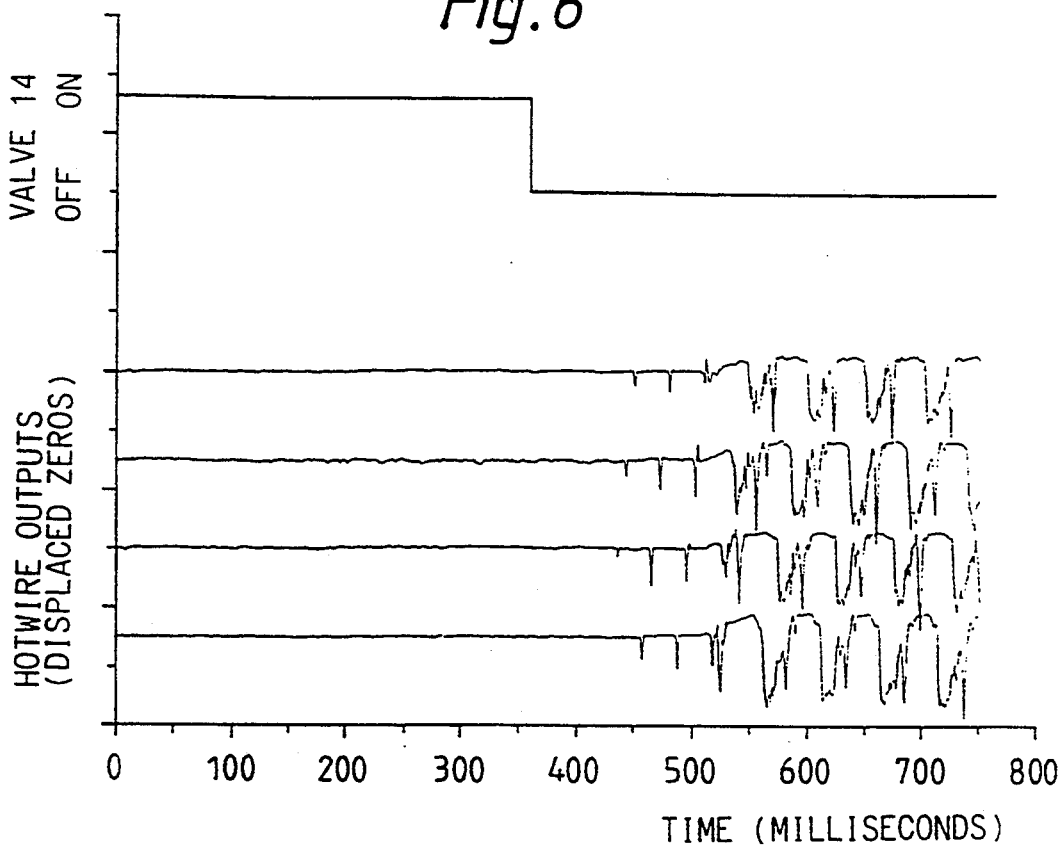

FIG. 6 illustrates the same set-up in which, conversely, overriding the control unit and switching the valve 14 closed allows the stall cell to reappear and a fully developed rotating stall condition quickly establishes itself.

To economize on the use of high pressure air, the control unit 22 should close the valves once the stall cell has been suppressed. The use of a timer to switch the valves off is illustrated in an experiment that produced the traces shown in FIG. 7. The steady flow is close enough to a critical condition for a stall cell to appear after a short time with the valves closed, but on each occasion when the control system is operative, the disturbance is quickly removed- As indicated by the trace S in FIG. 7, the control system was switched off after demonstrating its efficiency, whereupon the next re-emergence of the stall cell led to a rotating stall condition.

Figure 7:
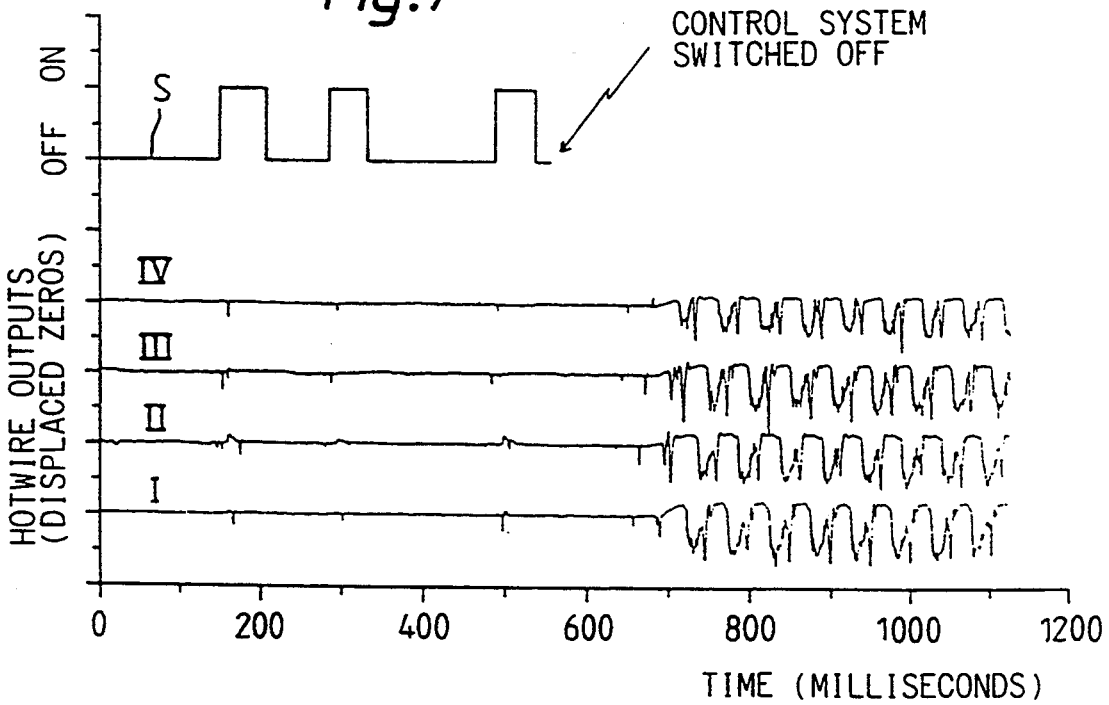
Figure 8:
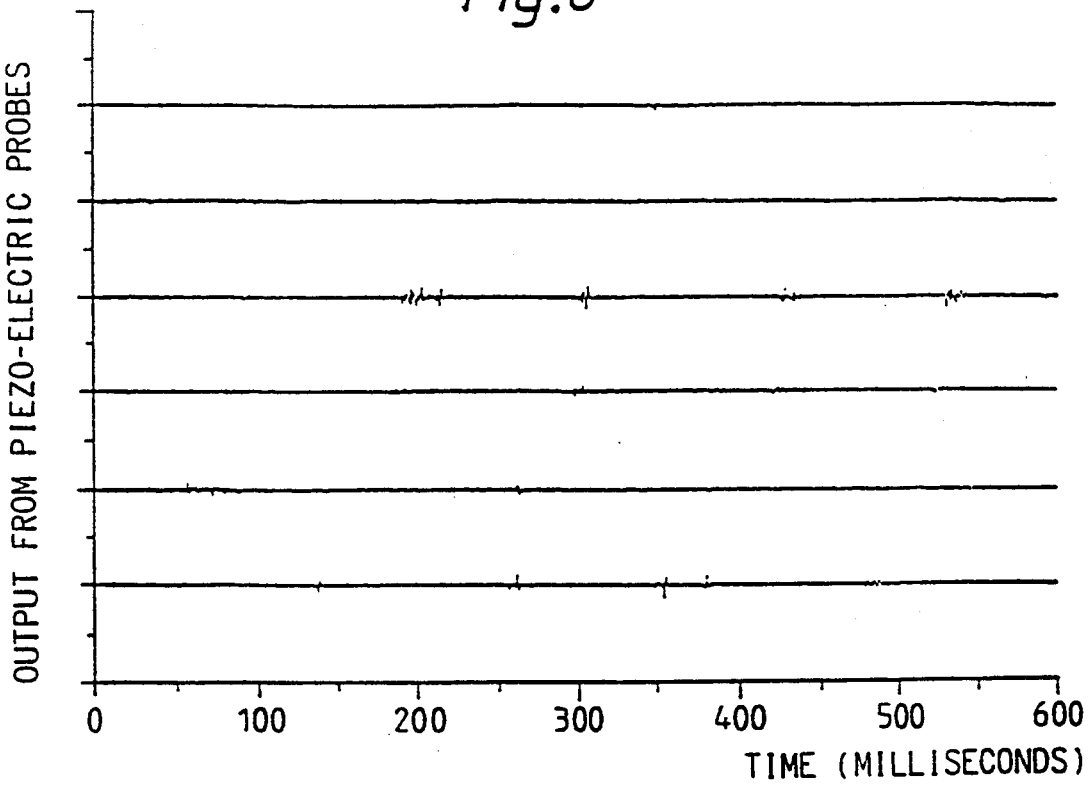
Figure 9:
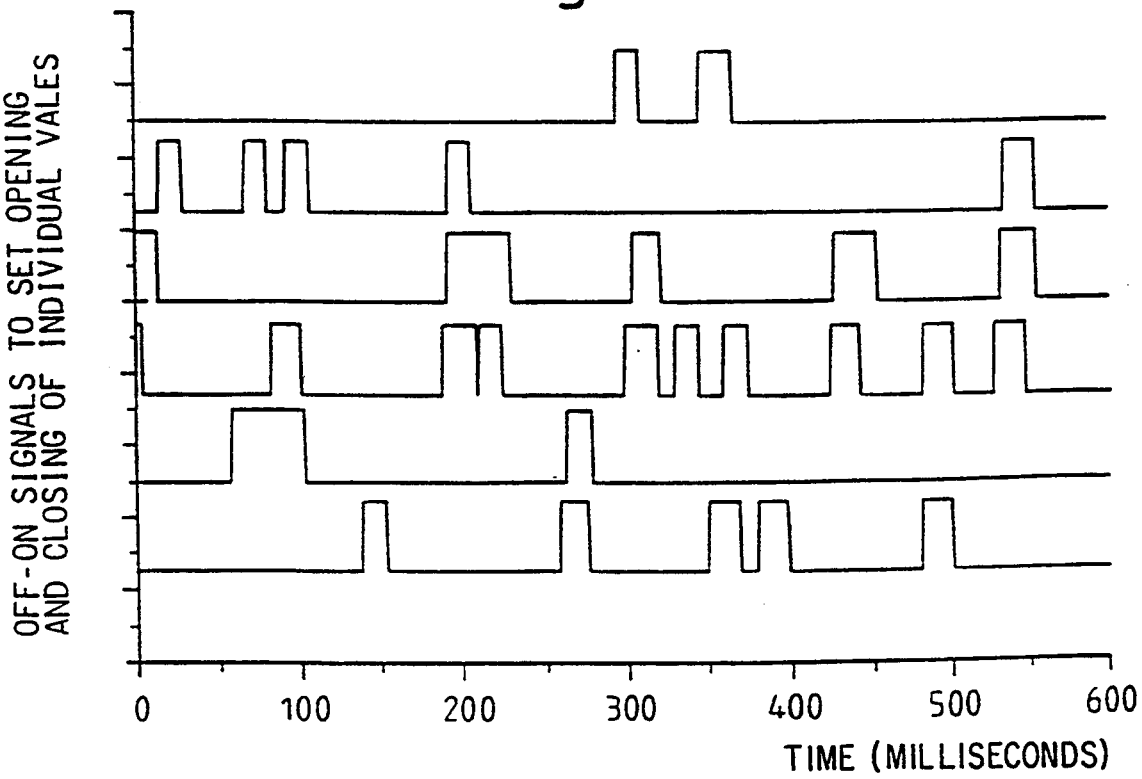

FIGS. 8 and 9 show a similar experiment to that in FIG. 7, here using piezo-electric sensors, which are able to actuate the opening of the individual injection valves each operatively linked with a circumferentially adjacent sensor to inject high pressure air through the inlets 8.

FIG. 8 demonstrates how the disturbance is suppressed each time that an incipient stall cell is detected. FIG. 9 shows the opening and closing sequence of the control valves which control the counteracting flow injection. As shown by some of the incidents in traces II and IV, it is possible to arrange for the control unit to respond to a persistent disturbance so fast that in effect the period of valve opening is extended.

Figure 10:
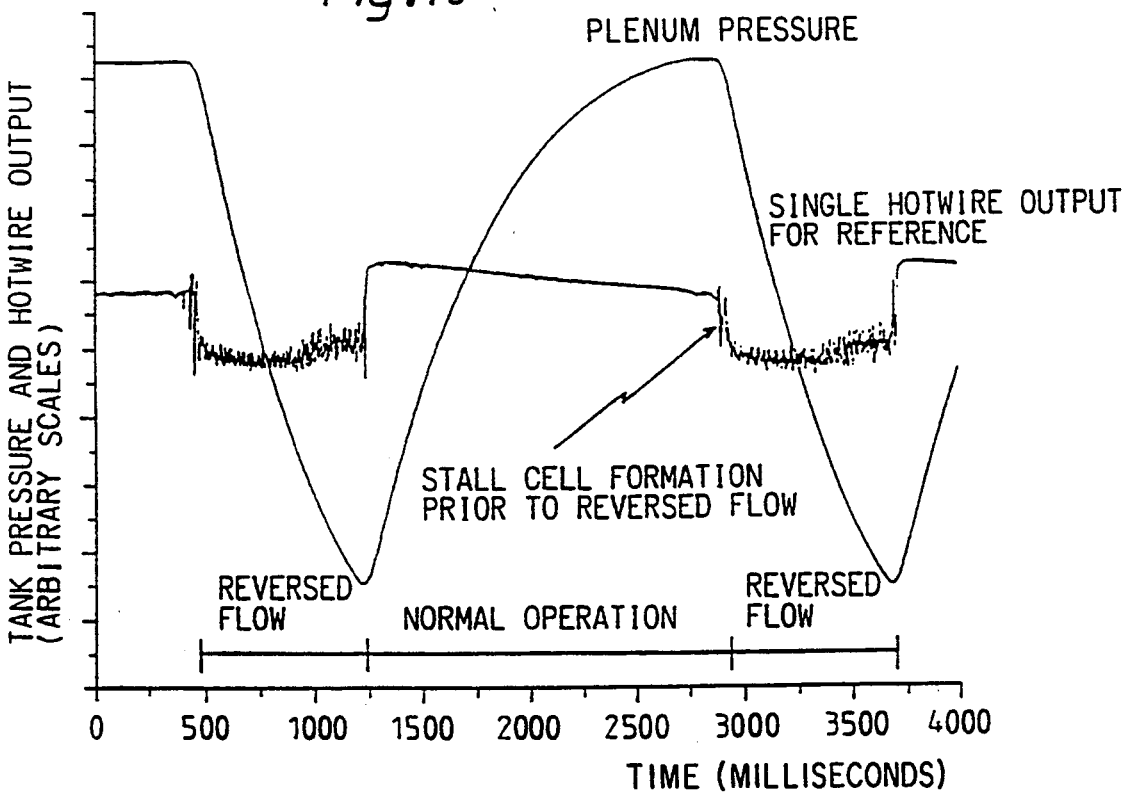

In FIG. 10 there is an illustration of the sensor traces recorded during a typical surge cycle in which the compressor of FIG. 4 delivers its output to a tank to produce a progressive pressure increase at the compressor outlet. After the initial disturbance of the steady state flow with stalling of the compressor, a reverse flow from the tank allows the exit pressure to fall until normal steady state flow is resumed, the cycle being repeated as the tank pressure rises to a critical level.

Figure 11:
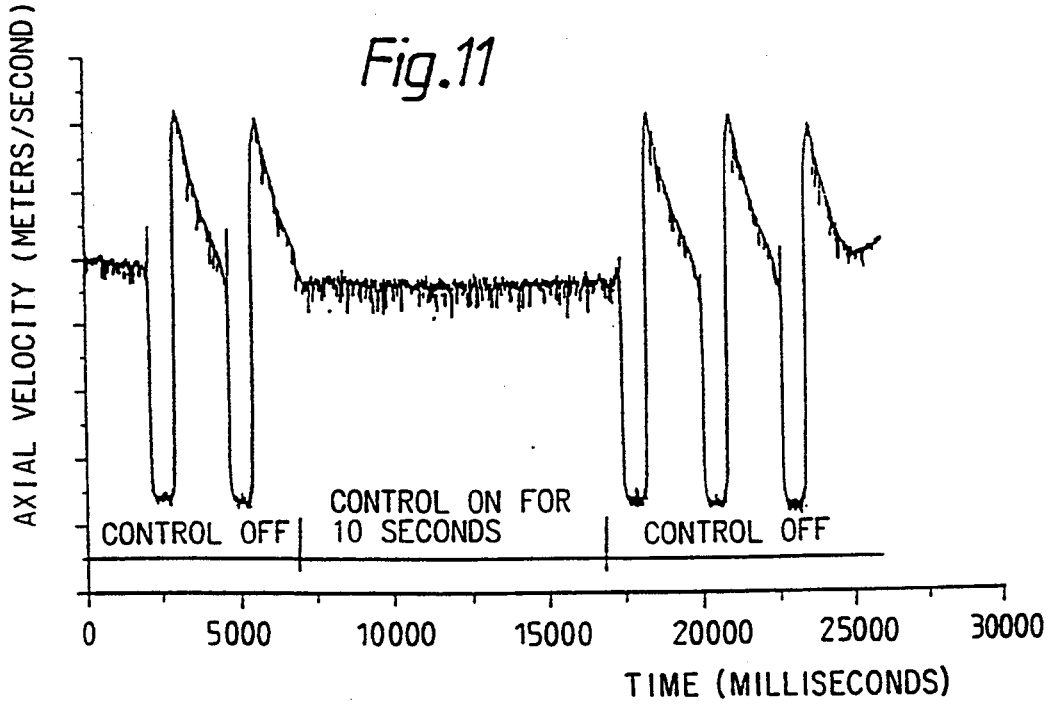

In FIG. 11, the same surge cycle is shown, to a compressed time scale, in which the control system was switched on for a period in the middle of the cycle. As will be clear, the surge cycle was suppressed by the operation of the injection valves and reappeared when the control system was switched off. The trace shows an output from a single hot-wire sensor ahead of the first rotor stage.

Figure 12:
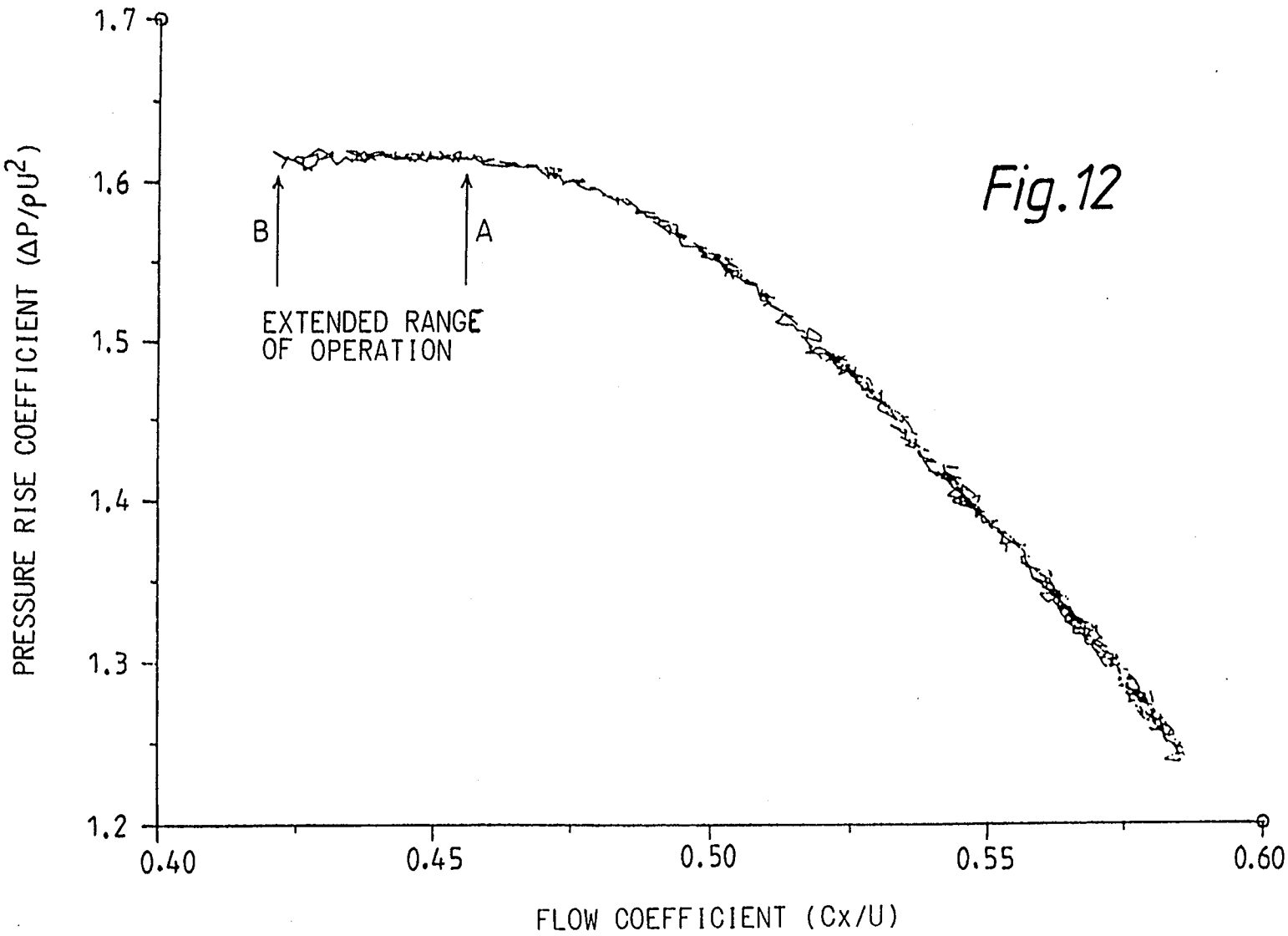
FIG. 12 is a graph of the compressor characteristic indicating the improvement of performance obtainable by the use of the control means.

FIG. 12 illustrates a typical pressure rise characteristic of an axial flow compressor. Without the use of the present invention, instability and a drastic drop in performance would be met at the point on the characteristic indicated by the arrow A. With the use of the invention, the characteristic extends to the point indicated by the arrow B before breakdown occurs. Since in actual performance it is necessary to operate with a significant safety margin because of the catastrophic consequences of breakdown, the extension of the range of operation offered by the use of the invention is able to yield a substantial improvement in performance.

Figure 13:
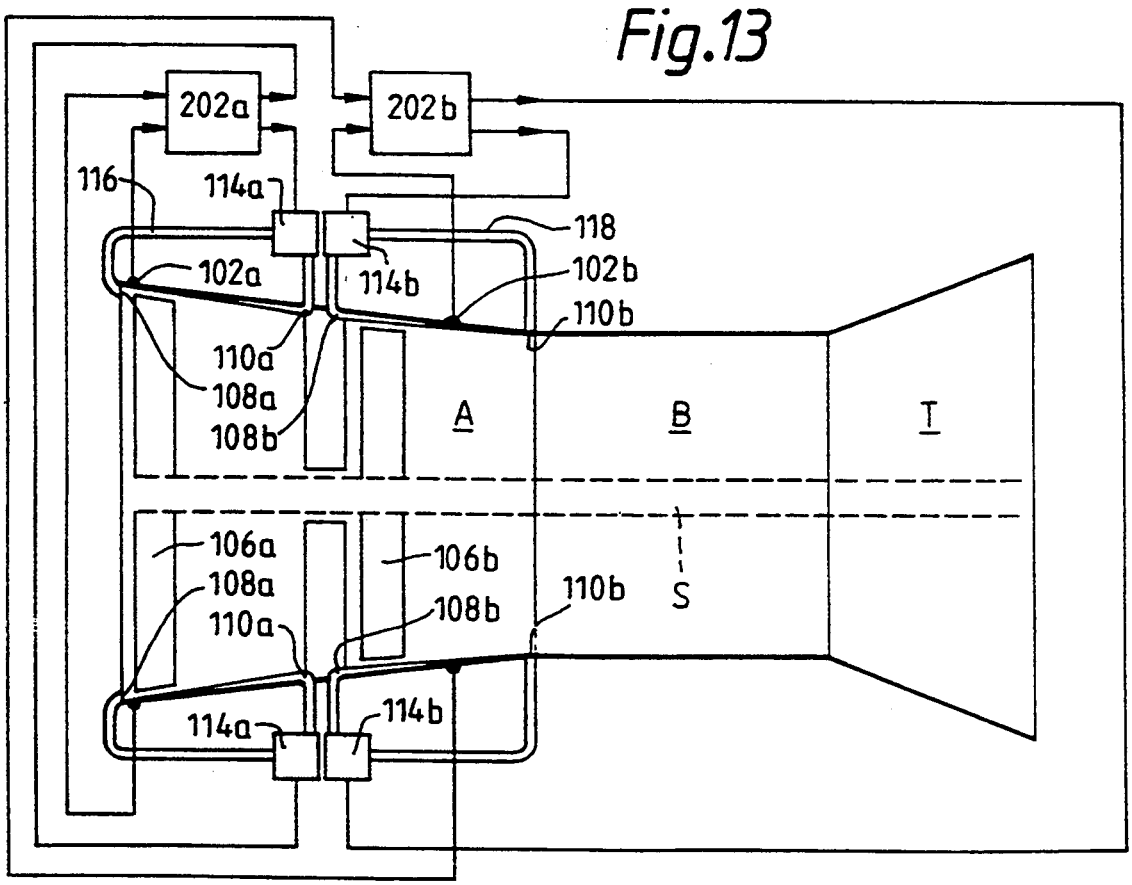
FIG. 13 is a schematic illustration of an axial flow jet engine provided with control means according to the invention.

FIG. 13 illustrates schematically the application of control apparatus according to the invention to a gas turbine which comprises an axial flow compressor A, combustion chamber B and turbine T, the compressor and turbine being coupled by a shaft S to rotate together. Flow sensors are located at two axial stations, namely the sensors 102*a* in front of the first stage of blades disc 106*a* and the sensors 102*b* behind a stage 106*b* near the high pressure outlet. At each station there is a series of three or more of the sensors 102 circumferentially equally spaced around the casing.

A first series of injection ports 108*a* are distributed around the compressor casing upstream of the front stage 106*a* but circumferentially offset from the sensors 102*a*. A similar series of bleed ports 110*a* around the circumference of an intermediate stage of the compressor allow gas flow through conduits 116 to the lower pressure regime at the injection ports 108*a* when normally closed valves 114*a* are opened. A further series of circumferentially distributed injection ports 108*b* adjacent the bleed ports 110*a* can receive higher pressure gas from similarly distributed bleed ports 110*b* through conduits 118 and further normally closed valves 114*b*. For clarity this arrangement of ports and valves is illustrated at diametrically opposite sides, but as is described below the circumference of the compressor is divided into a number of equal sectors, eg. 6 to 12, each of which has its own pair of valves 114*a*, 114*b* and associated conduits 116,118 controlling the flow through a series of injection and bleed ports distributed over the sector.

The arrangement shown in FIG. 13 provides two separate recirculation systems which can be operated independently of each other. As illustrated, the intermediate to front stage recirculation through the valves 114*a*, intended to counter low power instabilities, is regulated by a control circuit 202*a* in response to the signals from the sensors 102*a* at the front of the compressor. Recirculation from the rear to intermediate stages through the valves 114*b* is regulated by control circuit 202*b* in accordance with the signals from sensors 102*b* near the rear of the compressor- Further details of the control circuit 202 will be described with reference to FIGS. 17 and 18.

Figure 14:
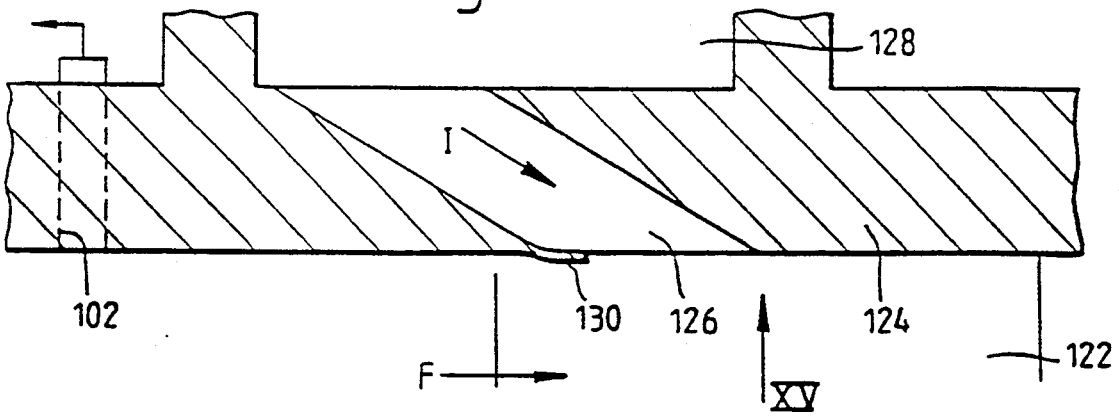
FIGS. 14 and 15 are detail views that illustrates schematically the air injection means at a portion of the circumference of a compressor casing.
Figure 15:
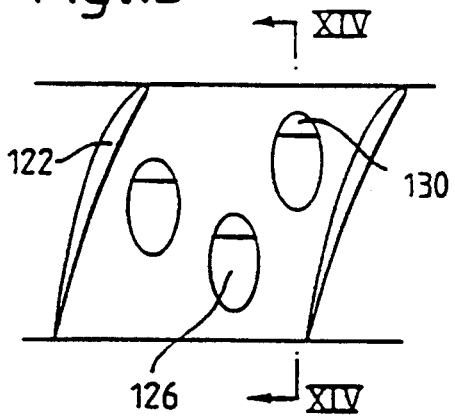
Figure 15A:
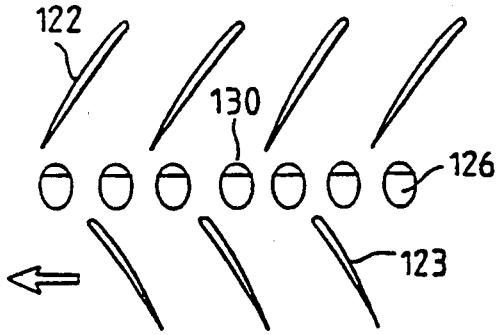
FIG. 15*a* is a detail view of a modified arrangement of injection ports.

FIGS. 14 and 15 illustrate in more detail the air injection arrangement at a typical port 108. The port is located in a ring of guide vanes 122 mounted on the casing inner wall 124 of an axial compressor. Each port comprises a group of three nozzles 126 opening into the compressor gas flow passage from a plenum 128. The nozzles are inclined at 30° to the axial direction to direct injected air I obliquely into the main flow F at as shallow a radial angle as possible. The division of the flow through a number of nozzles helps to keep the radial angle of injection small. To assist further in limiting the radial angle of injection a lip 130 shrouds the leading portion of the outlet of each nozzle. The nozzles 126 may also be inclined circumferentially so that the flow through them is injected with some whirl component in a direction counter to the whirl component of the main flow through the guide vanes FIG. 15*a* illustrates an alternative location of the ports 126, in the axial gap between the trailing edges of the stator guide vanes 122 and the leading edges of the rotor blades 123. An advantage of the arrangement shown in FIG. 15*a* is that the circumferential angle of injection can be more freely varied because it is not limited by the proximity of the stator guide vanes. The angle may be varied quite widely but it preferably lies between the axial direction and an angle to that direction substantially equal to the stagger angle of the rotor blades of the adjacent ring.

The ports 108 are disposed between each successive pair of guide vanes 122 and they are connected in groups to a series of six plenums 128 so that each plenum supplies injection air to a 60° sector of the compressor circumference. Each 60° sector has its own control valve 114 and is connected to the extraction porting 110 of a corresponding 60° sector at the downstream station. For each 60° sector there may be a sector there may be a single flow sensor 102, or a plurality of circumferentially spaced sensors, preferably at substantially the same axial station as the injection ports. The sensors 102 are preferably static pressure sensors mounted flush in the casing wall, as indicated in FIG. 14.

Figure 16:
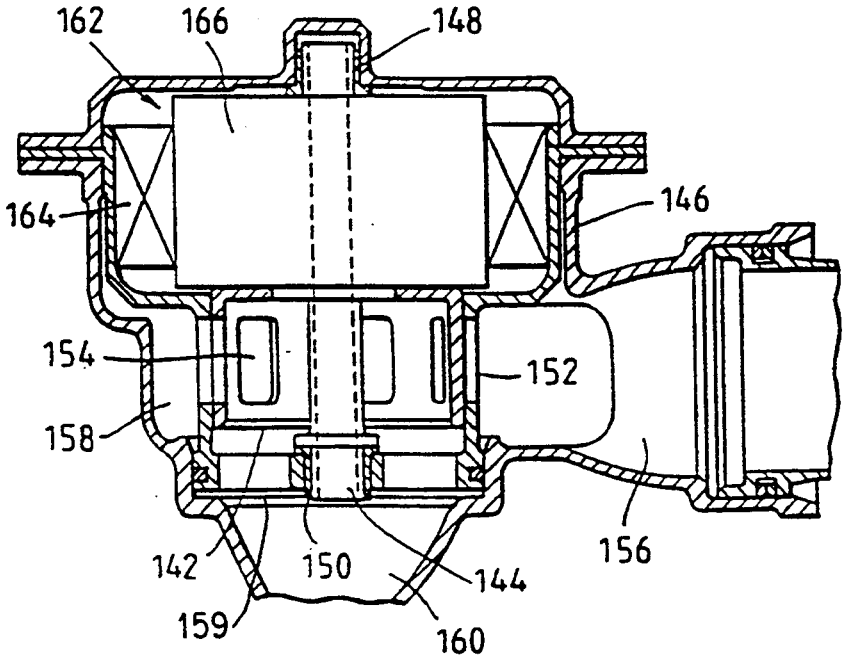
FIG. 16 is a sectional view of one form of control valve for the injection flow.

A preferred form of the valve 114 to obtain an appropriately fast response to the detection of a flow disturbance is shown in FIG. 16. This is an oscillatory rotary valve comprising a rotor 142 mounted on a spindle 144 in a casing 146 through upper and lower bearings 148,150. The rotor 142 is a hollow cylinder closely fitting but freely slidable in a cylindrical stator 152. Both rotor and stator have a series of spaced slots 154 in their cylindrical walls, and the two series of slots can be moved in and out of registry by a relatively small rotary movement of the rotor. With the slots out of registry flow through the valve is blocked. When the slots are in register, gas from supply conduit 156 reaching the encircling entry chamber 158 in the valve casing 146 can flow through the slots, past the spider 159 supporting the lower bearing 150 and through the valve outlet 160. To achieve fast switching the valve rotor has a lightweight construction, eg. of a carbon composite material. The stator is preferably made of the same material to ensure fit is maintained over a range of temperatures.

Movement of the valve is controlled electro-magnetically by a torque motor 162 comprising an electromagnet 164 secured in the casing and an armature 166 attached to the rotor 142. The motor is displaceable between end positions which correspond to the valve open and closed states so that no mechanical stops are required to locate the rotor at either position.

Figure 17:
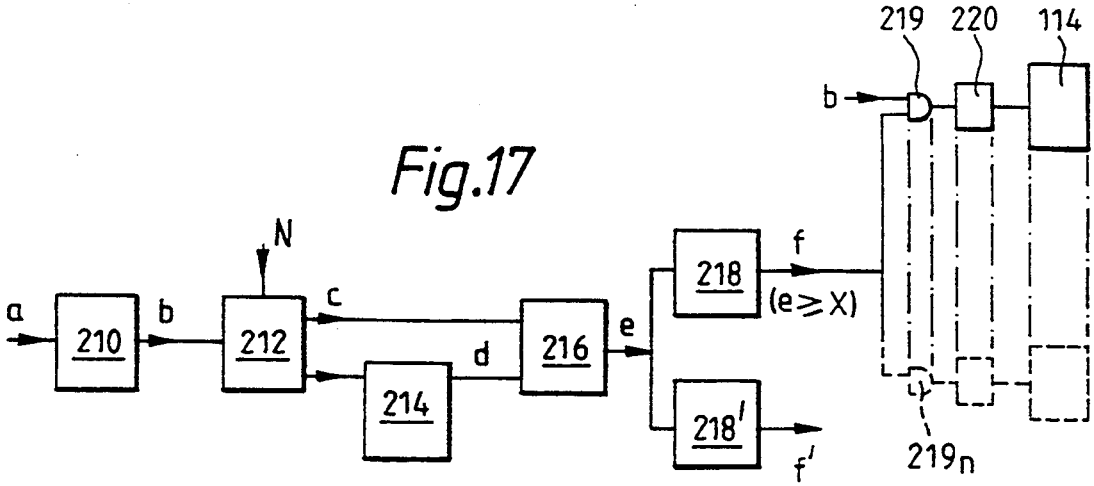
FIGS. 17 and 18 are block diagrams illustrating details of the control arrangement in FIG. 13.
Figure 18:
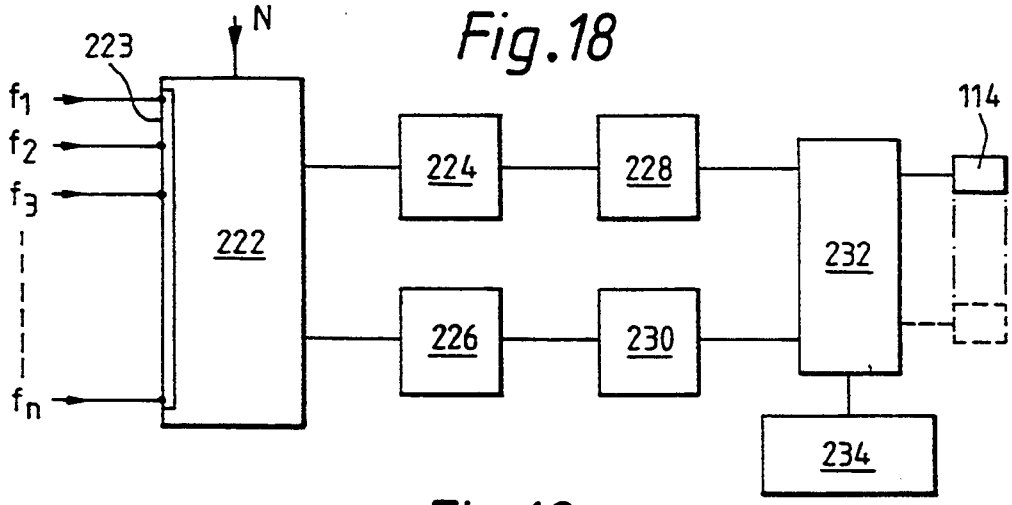

That part of a control circuit 202 dealing with an individual sensor output is shown in more detail in FIGS. 17 and 18. As shown in FIG. 17, the electronic signal a from each sensor output is first filtered in a low-pass filter 210 to remove blade order disturbances and the filtered signal b is then processed in an integrator 212. The integrator functions to give an average sensor value c over a rolling period equal to the sampling of at least three successive sensors 102—for example if there is one sensor per sector the rolling period can be as little as one half revolution- The average value gives a steady but continuously updated base level against which the magnitude of instantaneous variations can be measured.

The integrated output c is compared with the filtered instantaneous signal b in a subtraction unit 214, the difference d between the two signals being the perturbation, ie the divergence of the instantaneous signal from the rolling average- A divider circuit 216 calculates the ratio of the perturbation d to the current average value c, so that a non-dimensional measure e of the deviation is obtained. The output e from the divider circuit 216 is fed to at least a first discriminator 218 to be compared with a pre-set level X which must at least be matched if the air injection is to be operated. The output f from the discriminator is on if the magnitude of the division is greater than or equal to X. The pre-set perturbation operation level X is chosen to be the value that would appear in a stall condition.

The signals b obtained from the individual sensors and the outputs f are used to actuate an array of AND-gates **219–219*n* each linked to a respective valve 114. Each valve is opened when its AND-gate receives both an output f and a signal from the sensor circumferentially associated with its valve, and so produces an output which operates relay 220** of the valve. Each of the valves is therefore opened in turn in coordination with the circumferential position of the flow signal sensed when that signal has generated the perturbation output f. It will be seen that the valve to be opened may be for the same segment of the compressor air passage as that in which the perturbation was sensed, or it may be for a sector that follows in the direction of rotation if it is necessary to compensate for a lag in the response.

A further discriminator 218' in the circuit of FIG. 18 may also receive the signal e and be tuned to respond with an output f' at a level X' that is greater than the value that would appear in normal engine operating conditions such as acceleration and deceleration, but is less than the level that would appear in a stall condition. This can for example be used to counter flow distortion at extreme flight altitudes, for example.

Additional and/or alternative ways of providing the required recirculation flow may be achieved by processing the outputs f or f' as shown in FIG. 18. In the circuit of FIG. 18, a store 222 has addresses 223 for the outputs from the discriminators 218 for all of the sensors, of each stage. When an output $f|(e>X)$ occurs, that signal is held for at least the rolling period of the integrator 212, as determined by the input signal of compressor speed N. The values held in the store are extracted in step with the scanning of the addresses 223 and are summed in an addition circuit 224 for all of the sensors in the stage. Comparator 228 determines if the summed signals exceed predetermined values, whereupon a valve control circuit 22 os actuated to open the injection valve or valves 114 to the appropriate compressor locations. Simultaneously, a timer 234 is actuated to close the valves 114 again after a set period, which may correspond to as little as one or two revolutions of the compressor.

If it is desired to monitor the need for a recirculatory flow, such as from the ports **110*a* to the ports 108*a*, by means of flow sensors at a number of stages between these two sets of ports, the circuit of FIG. 18 can be further expanded by including a respective further addition circuit 226 for the sensors of different stages but similar circumferential position. It can be expected that these signals will reinforce each other if rotating stall is present. A comparator 230 determines if the summed signals exceed predetermined values to open the valve control circuit 232** in the manner already described.

Figure 19:
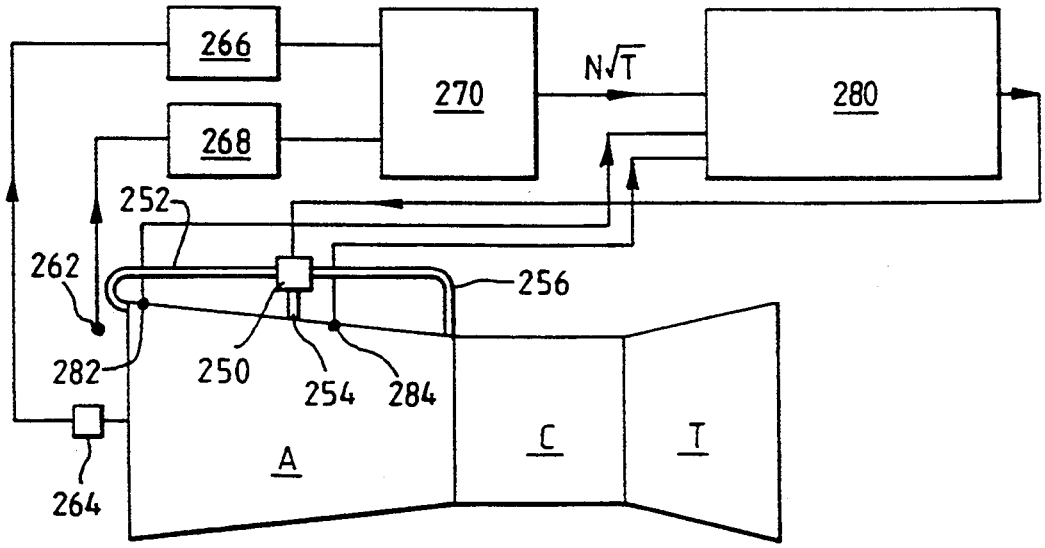
FIG. 19 is a schematic illustration of a further example of an axial flow jet engine provided with control means according to the invention.

FIG. 19 shows a gas turbine having an installation according to the invention with isolation valves 250 which are similar to the valves 114 but are designed for 3-way operation. Each valve 250 has three alternative positions, (i) closed, in which the conduits 252,254,256 communicating with the valve are isolated from each other, (ii) a first operative position, in which conduits 252,254 are connected together and the conduit 256 remains isolated, and (iii) a second operative position in which the conduits 254,256 are connected together and the conduit 252 is isolated. The valve 250 illustrated and its associated conduits of course represent only one of a series of such air circulation devices distributed at spaced intervals around the circumference of the compressor to take air from and deliver it to rings of nozzles at the chosen take-off and injection stages.

The control system shown in FIG. 19 includes an inlet temperature sensor 262 and a shaft speed sensor 264 which provide inputs through A-D convertors 266,268 of temperature T and rotational speed N to an operating unit 270. The unit 270 operates on the inputs to produce an output $N\sqrt{T}$ which represents the corrected speed, a parameter of flow conditions in the compressor.

A processing unit 280 operates in the manner already described with reference to the units 202, in accordance with signals from static pressure sensors 282,284 indicating a flow disturbance actuating the opening of the valves 250 to produce a fixed period of air injection. In addition, however, the value of the $N\sqrt{T}$ value is input to the processor 280 to determine whether the output from the unit 280 actuates the valve 250 to open the path 254,252 or the path 256,254. Lower values of $N\sqrt{T}$ indicate lower power operation of the compressor and the valve 250 is actuated so that air tapped from the intermediate station is injected into the front of the compressor via the conduits 252. Higher values of $N\sqrt{T}$ indicate that any disturbance to be acted upon requires correction in the downstream stages and the valve 250 so opens that air from the compressor exit is injected into the intermediate stage via the conduits 254.

It will be noted that, in contrast to an active control system, there is no linear feedback control in the systems that have been described. Because of this the control system can be considerably simplified. Detection of a disturbance exceeding a predetermined level produces a fixed response (with the possibility of discrete forms of response being available for different forms of disturbances). It is found that it is possible to take effective action even though this process requires a perturbation to become measurable before the response is initiated. If the disturbance persists the system can simply actuate a further fixed response.

The method of control according to the invention can also operate to counter a steady flow distortion, ie. some element of circumferential asymmetry in the flow which, although not necessarily leading to a catastrophic disruption of the flow, reduces the efficiency of the turbo-compressor. For this purpose, the control systems would be arranged to act on the appropriate single injection valves or selected groups of the valves at a particular station and sector when a steady flow distortion is indicated by the signals sensed.

If similar means for air injection are provided at a number of axial stations, the circumferentially corresponding injection conduits at two or more stations may share the same control valve. If injection is required only to counter incipient surge conditions, a circumferential series of injection conduits may be connected to a common control valve.

It may be mentioned here that although reference has been made to the injection flow being input in a circumferentially successive manner in response to the detection of a rotating stall cell, it is also possible to inject the flow simultaneously over the whole circumference, so that the control layout is simplified even though the injection flow may be used less economically.

It is possible to employ the collected data for further control functions. If the rolling average of the sensor outputs for any one stage of the compressor are added and the rolling average for each individual sensor is subtracted, a measure of circumferential steady distortion of the air flow is obtained. If a number of transducers in substantially the same line of flow through the compressor show a difference of sufficient magnitude from the average of their respective stages, the valve or valves associated with that flow line can be opened to reduce or prevent such steady state distortion. This can prevent distortion of the intake flow inducing surge prematurely. Further illustration of this mode of operation is not necessary as essentially the only addition required to perform this function is an extension of the logic algorithm of the circuit of FIG. 18 to compare the time average of each sensor input with the space and time average of its stage.

For most purposes it may be suitable to switch the injection flow on and off without any attempt to graduate the flow. It is possible, however, to control the injection in such a way as to minimize any loss of efficiency the recirculation produces. For example, instead of opening an injection valve fully when an instability is detected, the amount of opening may be graduated, or the injected flow volume may be reduced if the valve is opened and closed several times in quick succession. In the case of a graduated or proportional opening, it may be arranged that an initial command opens the valve eg. up to 25%, and then if there is a further command from the logic circuitry to open the valve it is opened wider. In this way detection of a minor unstable condition correctable by partial opening of the valve will not excite an excessive response with the resulting loss of engine efficiency. Graduation of the flow shut-off has already been referred to as a measure to increase efficiency. It will be seen that by the use of electromagnetic control for the preferred form of isolation valve, such controlled movements can readily be obtained by means known in the art, eg. a proportional response.

The form of response may also be matched to the type of instability being detected- In the case of rotating stall, the distortion will circulate around the circumference of any particular stage and if the distortion is sensed in sequence by the associated sensors, it may not De necessary to inject pressure air through all the inlets associated with that stage. A sequential injection in phase with the distortion may then be sufficient. That does not apply if the distortion is sensed simultaneously by all the sensors, indicating a surge condition.

The speed of response of the system is dependent upon the level of discrimination, which must be sufficiently low to enable corrective action to be initiated before any significant loss of engine power occurs, yet must not be so sensitive as to respond to the normal and inevitable variations that occur in the operation of an axial flow compressor, such as the blade to blade differences and the wake disturbances of each blade giving a blade passing frequency variation. This latter is usually the most significant noise component in the axial flow compressor of an aero engine and would give a variation there of about 2%. The limiting value for initiating corrective action, ie. the value of X for the discriminators 218 (FIG. 17), would thus be set above the 2% level in such an installation.

Although the invention has been described in relation to axial compressors, it is also applicable to the control of disturbances such as surge in centrifugal compressors.

Whereas the signal processing elements of the above embodiments of the invention have been described in connection with FIGS. 17 and 18 as discrete components or blocks in electronic circuits, it should be understood that the invention is not so limited and embraces such signal processing when carried out as program steps in a digital computer, a microprocessor-based control unit being the preferred option.

We claim:

1. A method of controlling gas flow in a compressor comprising the steps of sensing the flow at a series of circumferentially spaced positions at a chosen axial station in a direction of flow through the compressor to detect variations in the flow above a predetermined limit of variation and, upon at least one of the variations being detected, injecting higher-pressure gas from a region downstream of said chosen station into the flow through the compressor upstream of said region generally in said direction of flow and in a circumferentially selective manner dependent upon the circumferential origins of said variations, to act against flow disturbances indicated by said variations.

2. A method according to claim 1 wherein action is taken to terminate said injection after a fixed period.

3. A method according to claim 1 wherein the injection is tapered off after initiation.

4. A method according to claim 1 wherein the injection is shut off after a predetermined time.

5. A method according to claim 1, wherein flow variations above said predetermined limit are detected at one of a plurality of stations spaced from each other in the flow direction and said injection of higher-pressure gas is initiated adjacent said one station in response to said detection.

6. A method according to claim 5 wherein, flow variations are sensed at least a first station adjacent the entry of the compressor and at a second station intermediate the flow path through the compressor and higher-pressure gas is injected to act against flow variations detected at each said station, the higher-pressure gas for the first station being bled from adjacent said second station and the higher-pressure gas for the second station being bled from downstream of the second station.

7. A method according to claim 1 wherein the injection is performed in a series of different sectors around a circumference of the compressor, and the flow is independently sensed in each of said sectors.

8. A method according to claim 7 wherein the higher pressure gas is taken from the same sector as that into which it is injected.

9. A method according to claim 1 wherein a sensed signal of said variations at each said spaced position at the station is averaged over a rolling period corresponding to the sensing of the flow at least at three circumferentially successive locations to give a series of means values, from which a flow disturbance is detected.

10. A method according to claim 9 wherein a difference signal is formed between the sensed signal and the mean signal, a measure of a relative magnitude of the difference signal is obtained, and a detection of the relative magnitude above a predetermined level of the difference signal from each of a plurality of the sensing positions is arranged to produce an operative output for actuating the injection.

11. A method according to claim 1 wherein actuation of the injection is arranged to operate on sensing sequentially, for at least some of said circumferentially spaced positions of the station, the flow variations above the predetermined limit.

12. A method according to claim 1 wherein said direction of injection is at a radial angle not substantially more than 30°.

13. A method according to claim 1 for controlling flow in an axial compressor in which said direction of injection has a circumferential component in opposition to a direction of rotation of the compressor rotor.

14. A method according to claim 1 wherein said limit of flow variation is not substantially less than 2% of a mean flow value sensed.

15. A method according to claim 1, wherein flow variations above said predetermined limit are detected at one of a plurality of stations spaced from each other in the flow direction and said injection of higher-pressure gas is initiated a substantial distance upstream of said station in response to said detection.

16. A method of controlling gas flow in a compressor comprising the steps of sensing the flow at a series of circumferentially spaced positions at a chosen axial station in the direction of flow through the compressor to detect variations in the flow above a predetermined limit of variation, the sensing of said variations at a series of said positions in circumferential sequence actuating the injection of gas at a higher pressure than that prevailing at said station to act against a flow disturbance indicated by said variations, and performing the gas injection in a series of different sectors around the compressor, said injection being generally in said direction of flow through the compressor and the flow being independently sensed in each of said sectors.

17. A method of controlling gas flow in a compressor comprising the steps of sensing the flow at a series of circumferentially spaced positions to detect a variation in the flow in one circumferential region relative to another and, upon the variation being detected injecting, generally in the direction of flow through the compressor, higher-pressure gas from a region downstream of said series of circumferentially spaced positions toward a circumferential region in which said variation has been detected.

18. Apparatus for controlling gas flow in a compressor comprising flow sensing means for a series of circumferentially spaced positions at a chosen axial station in a direction of flow through the compressor, means for detecting from signals from the sensing means at the individual positions flow variations above a predetermined limit of variation, means for injecting gas at a higher pressure than that prevailing at said station and generally in the direction of flow, means for actuating said injection means in response to the sensing of said variations at a series of said positions in circumferential sequence thereby to act against a flow disturbance indicated by said variations.

19. Apparatus for controlling gas flow in compressor comprising sensing means for sensing variations in flow at a series of circumferentially spaced positions at a chosen axial station in a direction of main flow through the compressor, means for tapping higher-pressure gas from a region downstream of said chosen station, means for injecting said higher-pressure gas into the compressor generally in said direction of flow, to act against a flow disturbance indicated by said variations, and control means for controlling said injection, the sensing means actuating said injection through said control means in a circumferentially selective manner dependent upon the circumferential origins of said variations.

20. Apparatus according to claim 19 wherein said sensing means are provided at a plurality of stations spaced from each other in the flow direction and said injection means are provided one of at and adjacent said stations, the control means being arranged to initiate said injection in response to the direction of said flow variations at said station.

21. Apparatus according to claim 19 comprising a first station adjacent the entry to the compressor and a second station intermediate the flow path trough it, first injection means one of at and adjacent said first station, second injection means a substantial distance upstream of said second station, first conduit means for connecting said first injection means to the main compressor flow downstream of the first station and second conduit means for the injection to said second station having means for connecting said second injection means to the main compressor flow downstream of said second station.

22. Apparatus according to claim 21 wherein a common valve means is provided to selectively block said injection and either of said conduit means.

23. Apparatus according to claim 19 wherein the flow control means is biased to a normally closed position.

24. Apparatus according to claim 19 wherein there are tapping means and injection means for each of a plurality of different sectors of the compressor, and there are sensing means for each of said sectors, control means actuable by the sensing means being operable for injection into each of said sectors.

25. Apparatus according to claim 24 wherein there are at least six said sectors.

26. Apparatus according to claim 19 wherein the injection means comprises outlets directed at a radial angle of not substantially more than 30°.

27. Apparatus according to claim 26 wherein said outlets comprise nozzles in which a projecting portion at each nozzle exit deflects the injection in a downstream direction.

28. Apparatus according to claim 19 wherein said control means comprises at least one semirotary valve comprising a cylindrical stator and a cylindrical rotor in close sliding fit with said stator, the stator and rotor each having a series of circumferentially spaced openings that are brought into and out of registration by rotation of the rotor to open and close the valve.

29. Apparatus according to claim 28 wherein electromagnetic drive means determine the end positions of the rotary movement of the rotor.

30. Apparatus according to claim 19 comprising means for one of reducing and stopping said injection in a predetermined time period.

31. Apparatus according to claim 19 wherein the control means comprises means for averaging the signal sensed at each said spaced position over a rolling period corresponding to the sensing of the flow at least at three circumferentially successive locations to give a series of mean values from which a flow disturbance is detected.

32. Apparatus according to claim 31 comprising means for forming a difference signal between the instantaneous sensed signal and the mean signal, means for measuring the relative magnitude of said difference signal and output means for producing an actuating signal for the injection upon detection of a relative magnitude above a predetermined level from each of a plurality of the sensing positions.

33. An apparatus according to claim 19, wherein said sensing means are provided at a plurality of stations spaced from each other in the flow direction and said injection means are provided a substantial distance upstream of one of said stations, the control means being arranged to initiate said injection in response to the detection of said flow variations at said one station.

* * * * *

UNITED STATES PATENT AND TRADEMARK OFFICE

CERTIFICATE OF CORRECTION

PATENT NO. : 5,340,271

DATED : August 23, 1994

INVENTOR(S) : Christopher Freeman and William B. Wright

It is certified that error appears in the above-indentified patent and that said Letters Patent is hereby corrected as shown below:

On The Title Page:
[86] § 371 Date: change "Jan. 14, 1949" to --Jan. 14, 1993--.

Signed and Sealed this

First Day of November, 1994

*Attest:*

*Attesting Officer*

BRUCE LEHMAN

*Commissioner of Patents and Trademarks*